US007413002B2

(12) United States Patent
Ninagawa et al.

(10) Patent No.: US 7,413,002 B2
(45) Date of Patent: Aug. 19, 2008

(54) CORRUGATED FIN AND HEAT EXCHANGER USING THE SAME

(75) Inventors: Toshihide Ninagawa, Yatomi (JP); Yuuji Sako, Hazu-gun (JP); Yoshihiko Sonoda, Tokoname (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/639,114

(22) Filed: Dec. 14, 2006

(65) Prior Publication Data

US 2007/0137840 A1 Jun. 21, 2007

(30) Foreign Application Priority Data

Dec. 16, 2005 (JP) ..... 2005-362786

(51) Int. Cl.
*F28F 1/22* (2006.01)

(52) U.S. Cl. ..... 165/152; 165/151

(58) Field of Classification Search ..... 165/151, 165/152, 182
See application file for complete search history.

(56) References Cited

U.S. PATENT DOCUMENTS 3,003,749 A * 10/1961 Morse ..... 165/152
5,730,214 A * 3/1998 Beamer et al. ..... 165/152
5,915,471 A * 6/1999 Kim ..... 165/151
5,992,514 A * 11/1999 Sugimoto et al. ..... 165/135
6,357,518 B1 * 3/2002 Sugimoto et al. ..... 165/140
6,401,809 B1 * 6/2002 Zhang et al. ..... 165/146
6,662,861 B2 * 12/2003 Ozaki et al. ..... 165/140
6,918,432 B2 * 7/2005 Ozaki ..... 165/152
6,968,891 B2 * 11/2005 Tochigi et al. ..... 165/152
2002/0189799 A1 * 12/2002 Ozaki ..... 165/152
2006/0157233 A1 * 7/2006 Ozaki et al. ..... 165/152
2007/0051502 A1 * 3/2007 Yamauchi ..... 165/151

FOREIGN PATENT DOCUMENTS

JP 2002-205122 7/2002

* cited by examiner

*Primary Examiner*—Allen J Flanigan
(74) *Attorney, Agent, or Firm*—Harness, Dickey & Pierce, PLC

(57) ABSTRACT

In a corrugated fin which is formed and bent into a wave-form, a plurality of both-side-cut-louvers 8, which are laminated on each other and formed into a group, and one-side-cut-louvers 7, which are arranged at end portions of the group of both-side-cut-louvers 8, are formed being raised, and a cross-section in the louver laminating direction of at least one of the one-side-cut-louvers 7 is formed into a substantial V-shape. An inclined face 70 of the one-side-cut-louver 7 adjoining the both-side-cut-louver 8 is made to cross a centerline in the fin thickness direction and a length of the inclined face 70 is made to be the same as that of the inclined face of the adjoining both-side-cut-louver 8.

7 Claims, 12 Drawing Sheets

CORRUGATED FIN AND HEAT EXCHANGER USING THE SAME

BACKGROUND OF THE INVENTION

1. Technical Field of the Invention

The present invention relates to a corrugated fin fixed onto an outer surface of a tube of a heat exchanger. More particularly, the present invention relates to a corrugated fin, on the surface of which a large number of louvers are formed.

2. Description of the Related Art

Conventionally, in order to increase a heat transfer area of a heat exchanger, the top and bottom portions of a corrugated fin are joined onto an outer surface of a flat tube in which a heat transfer medium flows. This corrugated fin is composed in such a manner that a thin metallic strip made of aluminum is bent into a wave-shape and a large number of louvers (sloping slats) are formed on the surface of the wave-shaped metallic strip.

The above corrugated fin is continuously formed when a metallic strip is supplied to a pair of forming-rollers. In the pair of forming-rollers, as a cutting edge for raising a large number of louvers, a large number of disk-shaped edges, on both sides of which edges are provided, are laminated together, and edges, on the one side of which an edge is provided, are arranged on both sides. Both-side-edges of a pair of forming-rollers form both-side-cut-louvers, and one-side-edges form one-side-cut-louvers.

However, although an inclination angle of the one-side-edge for forming the one-side-cut-louver J7 is the same as an inclination angle of the inclined face of both-side-edge, as shown in FIG. 13, the inclination angle of the one-side-cut-louver J7 after forming is smaller than the inclination angle of the both-side-cut-louver J8. The reason is that an amount of spring-back after forming of the corrugated fin of the both-side-cut-louver J8 and an amount of spring-back after the forming of the corrugated fin of the one-side-cut-louver J7 are different.

Due to the foregoing, a volume of air flowing in the opening portion of the one-side-cut-louver J7 becomes smaller than a volume of air flowing in the other both-side-cut-louver J8. Further, the air flowing angles are different from each other. Accordingly, the air current loses balance. Therefore, the heat exchange performance is deteriorated in the neighborhood of the one-side-cut-louver J7.

In order to solve the above problems, the following corrugated fin is proposed in the official gazette of JP-A-2002-205122. When a shape of the one-side-edge is changed, the spring-back of the one-side-cut louver is seldom caused, and the inclination angle of one-side-cut-louver and the inclination angle of the both-side-cut-louver are made to be the same.

However, in the corrugated fin described in the official gazette of JP-A-2002-205122, the shape of the one-side-edge is made to be a special shape different from the shape of the other edge. Therefore the manufacturing cost of the rollers for forming the corrugated fin is increased. Further, the forming property for forming the corrugated fin is deteriorated.

SUMMARY OF THE INVENTION

The present invention has been accomplished to solve the above problems. It is an object of the present invention to provide a corrugated fin capable of reducing a difference between the one-side-cut-louver and the both-side-cut-louver by a simple structure. It is another object of the present invention to provide a heat exchanger in which the corrugated fin is used.

In order to accomplish the above object, one aspect of the present invention provides a corrugated fin bent and formed into a wave-shape, a plurality of both-side-cut-louvers (8), which are laminated on each other and formed into a group, and one-side-cut-louvers (7), which are arranged at end portions of the group of both-side-cut-louvers (8), being raised from the corrugated fin, a cross section in the louver laminating direction of at least one of the one-side-cut-louvers (7) is formed into a substantial V-shape, an inclined face (70) of the one-side-cut-louver (7) adjacent to the both-side-cut-louver (8) crosses a centerline of the fin in the wall thickness direction and a length of the adjoining-inclined face (70) of the one-side-cut-louver (7) is the same as that of the inclined face of the both-side-cut-louver (8).

As described above, the one-side-cut-louver (7) is formed into a substantial V-shape, and the inclination face (70) forming a substantial V-shape of the one-side-cut-louver (7) is made to cross the centerline of the fin in the wall thickness direction. Further, the length of the one-side-cut-louver (7) is made to be the same as that of the inclination face of the adjoining both-side-cut-louver (8). Due to the foregoing, the one-side-cut-louver (7) can be formed with a both-side-edge used for forming the both-side-cut-louver (8). Therefore, a blade contact length of the inclination face (70) forming the substantial V-shape of the one-side-cut-louver can be made to be the same as an edge contact length of the both-side-cut-louver (8). Accordingly, an amount of the spring-back of the one-side-cut-louver (7) and an amount of the spring-back of the both-side-cut-louver (8) can be made substantially the same. Therefore, a difference between the inclination angle of the one-side-cut-louver (7) and the inclination angle of the both-side-cut-louver (8) can be reduced. Accordingly, an air current at each portion of the louvers can be made to be the same. Therefore, the heat exchange can be facilitated.

In this case, the group of both-side-cut-louvers (8) includes two groups of both-side-cut louvers (8), the inclination directions of which are opposite to each other, and the one-side-cut-louver (7), the shape of which is formed into a V-shape, can be arranged between the groups of both-side-cut-louvers (8).

Due to the foregoing, at a central turning portion, which is located at a substantial central portion in the louver laminating direction of the group of louvers and at which a direction of the both-side-cut-louver (8) is inverted, that is, a direction of the air current is inverted, a length of the inclination face 70 of the one-side-cut-louver 7 and a length of the both-side-cut-louver 8 can be made to be the same. Therefore, at the central turning portion, an air current can be easily turned. Accordingly, the air current can be maintained in an ideal direction (a V-shaped current) and the heat exchange can be facilitated.

The group of both-side-cut-louvers (8) includes two groups of both-side-cut louvers (8), the inclination directions of which are opposite to each other, and the one-side-cut-louver (7), the shape of which is formed into a V-shape, is arranged at both end portions of the two groups of both-side-cut-louvers (8).

Due to the foregoing, an air current can be positively taken in from the opening portion formed between the one-side-cut-louver (7) and the both-side-cut-louver (8). Accordingly, the heat exchange performance can be enhanced.

Another aspect of the present invention provides a corrugated fin bent and formed into a wave-shape, a plurality of both-side-cut-louvers (8), which are laminated on each other and formed into a group, and one-side-cut-louvers (7), which are arranged at end portions of the group of both-side-cut-louvers (8), being raised from the corrugated fin, a cross section in the louver laminating direction of at least one of the one-side-cut-louvers (7) is formed into a substantial W-shape, an inclined face (70) of the one-side-cut-louver. (7) adjacent to the both-side-cut-louver (8) crosses a centerline of the fin in the wall thickness direction and a length of the inclined face of the one-side-cut-louver (7) is the same as that of the inclined face of the both-side-cut-louver (8).

As described above, the one-side-cut-louver (7) is formed into a substantial W-shape, and the inclined faces (70) forming a substantial W-shape of the one-side-cut-louver (7) are made to cross the centerline of the fin in the wall thickness direction. Further, the length of the one-side-cut-louver (7) is made to be the same as that of the inclination face of the adjoining both-side-cut-louver (8). Due to the foregoing, the one-side-cut-louver (7) can be formed with a both-side-edge used for forming the both-side-cut-louver (8). Therefore, an edge contact length of the inclination face (70) forming the substantial W-shape of the one-side-cut-louver (7) can be made to be the same as an edge contact length of the both-side-cut-louver (8). Accordingly, an amount of spring-back of the one-side-cut-louver (7) and an amount of spring-back of the both-side-cut-louver (8) can be made substantially the same. Therefore, a difference between the inclination angle of the one-side-cut-louver (7) and the inclination angle of the both-side-cut-louver (8) can be reduced. Accordingly, an air current at each portion of the louvers can be made to be the same. Therefore, the heat exchange can be facilitated.

In this case, the group of both-side-cut-louvers (8) includes two groups of both-side-cut louvers (8), the inclination directions of which are opposite to each other, and the one-side-cut-louver (7), the shape of which is formed into a substantial W-shape, is arranged between the groups of the both-side-cut-louvers (8).

Due to the foregoing, it is possible to expect a forward end effect at the central turning portion by a substantially W-shaped protruding portion of the one-side-cut-louver (7). Therefore, the heat transfer coefficient can be enhanced. Further, it is possible to extend a length of the central turning portion in the louver laminating direction. Therefore, it is possible to ensure a sufficiently large section needed for turning a direction of the air current. Due to the foregoing, it is possible to maintain the air current in an ideal direction (a V-shaped current). Accordingly, the heat exchange can be facilitated.

The group of both-side-cut-louvers (8) includes two groups of both-side-cut louvers (8), the inclination directions of which are opposite to each other, and the one-side-cut-louver (7), the shape of which is formed into a substantial W-shape, is arranged at both end portions of the two groups of both-side-cut-louvers (8).

In another aspect of the present invention, a heat exchanger comprises: a plurality of tubes in which a heating medium flows; and fins joined onto external faces of the tubes, for facilitating heat exchange with the heating medium, wherein the fins are the corrugated fins of the above aspects.

When the corrugated fin as described above is used for the heat exchanger, the heat exchanging capacity can be enhanced.

The present invention may be more fully understood from the description of the preferred embodiments of the invention, as set forth below, together with the accompanying drawings.

DESCRIPTION OF THE PREFERRED EMBODIMENTS

First Embodiment

Referring to FIGS. 1 to 5, a first embodiment of the present invention will be explained below. A corrugated fin of this embodiment is used for a radiator in which heat is exchanged between cooling water (heat transfer medium), which has cooled an engine for vehicle use, and the air.

Figure 1:
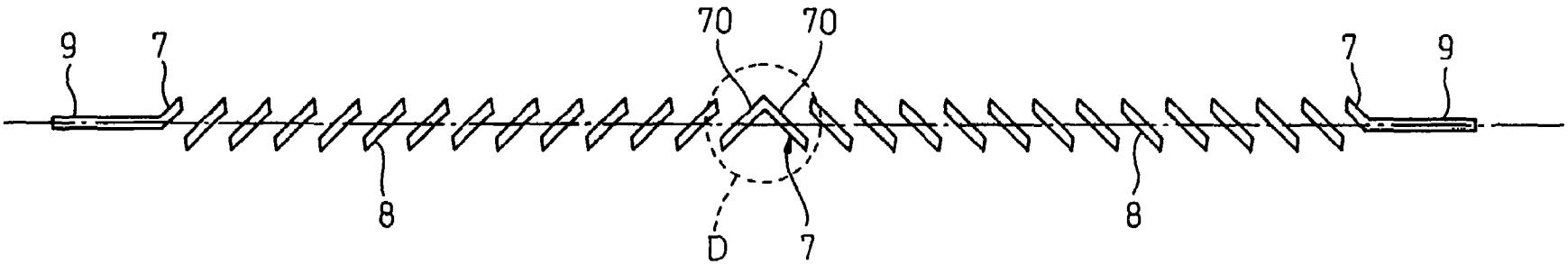
FIG. 1 is a sectional view for explaining louvers of a corrugated fin of a first embodiment of the present invention.

FIG. 1 is a sectional view for explaining louvers of a corrugated fin of the first embodiment of the present invention. In this connection, a one-dotted chain line in FIG. 1 shows a centerline of the corrugated fin in the wall thickness direction.

As shown in FIG. 1, the corrugated fin of the present embodiment includes: a plurality of both-side-cut-louvers (sloping slats) 8 which are laminated on each other and formed into a group, the inclination directions of which are the same, that is, the raising directions of which are the same; and one-side-cut-louvers (sloping slats) 7 arranged at end portions of the groups of the both-side-cut-louvers 8. Between two both-side-cut-louver 8 groups, the inclination directions of which are opposite to each other, a central turning portion is composed which is arranged at a substantially central portion in the louver laminating direction of the louver groups and in which directions of the both-side-cut-louvers 8 are reverse to each other, that is, a direction of the air current flowing in the central turning portion is inverted.

The one-side-cut-louvers 7 are arranged at the central turning portion and both end portions (which will be referred to as louver-group-both-end-portions hereinafter) of two groups of the both-side-cut-louvers 8, the inclination directions of which are opposite to each other. At both end portions of the louver groups, outside of the one-side-cut-louvers 7 in the louver laminating direction, flat portions 9, which are not inclined, that is, which are parallel with the centerline of the fin wall thickness direction, are arranged.

As shown by portion D in FIG. 1, the one-side-cut-louver 7 in the central turning portion of the corrugated fin is composed in such a manner that a cross section in the louver laminating direction is formed into a substantial V-shape. More particularly, the one-side-cut-louver 7 has two inclined faces 70, and these two inclined faces 70 are arranged in a substantial V-shape. More specifically, the one-side-cut-louver 7 has two inclined faces 70. These two inclined faces 70 are arranged in a substantial V-shape.

In this case, a substantial V-shaped protruding portion of the one-side-cut-louver 7 is protruded from a centerline of the fin in the wall thickness direction into a side opposite to the side on which the end portions of the two inclined faces 70 do not form the V-shaped protruding portion. In other words, the two inclined faces 70 of the one-side-cut-louver 7 respectively cross the centerline of the corrugated fin in the wall thickness direction. A length of the two inclined faces 70 is the same as the length of the adjoining both-side-cut-louver 8, and a direction of the two inclined faces 70 is the same as the direction of the adjoining both-side-cut-louver 8, Next, a method of forming the corrugated fin of the present embodiment will be explained below.

Figure 2:
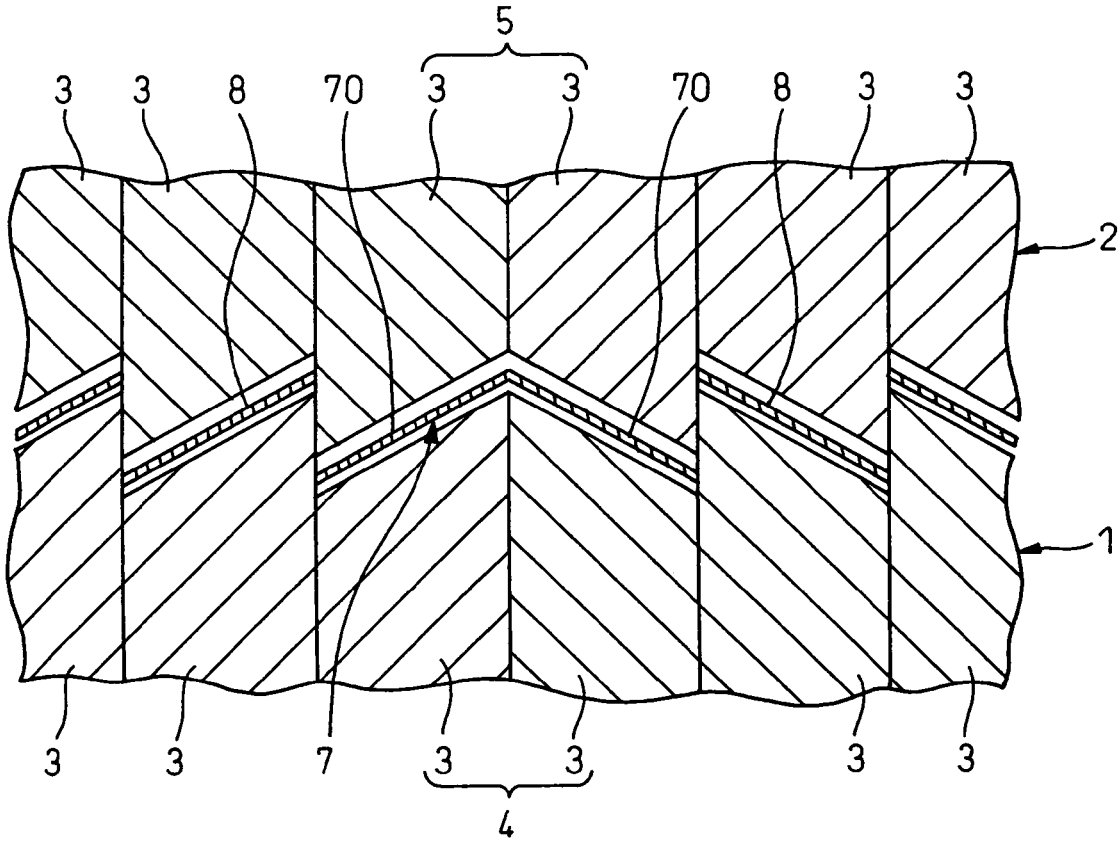
FIG. 2 is a sectional view for explaining a corrugated fin-forming-roller at the time of forming the corrugated fin in the first embodiment.

FIG. 2 is a sectional view for explaining a corrugated fin-forming-roller at the time of forming a corrugated fin in the first embodiment. In this connection, FIG. 2 shows a state in which a metallic strip is supplied to a pair of the first forming-roller 1 and the second forming-roller 2 and the forming-rollers are a little away from the roller engaging state.

As shown in FIG. 2, in the corrugated fin-forming-roller, the first one-side-edge 4 for forming the one-side-cut-louver 7 includes two both-side-edges 3. More specifically, two both-side-edges 3 composing the first one-side-edge 4 are respectively arranged in the same direction as that of the adjoining both-side-edge 3. That is, the two both-side-edges 3 composing the first one-side-edge 4 are respectively arranged in the opposite direction.

In the same manner, the second one-side-edge 5 for forming the one-side-cut-louver 7 includes two both-side-edges 3. More specifically, two both-side-edges 3 composing the second one-side-edge 5 are respectively arranged in the same direction as that of the adjoining both-side-edge 3. That is, two both-side-edges 3 composing the second one-side-edge 5 are respectively arranged in the opposite direction. Therefore, when a metallic strip is supplied, the metallic strip is bent into a substantial V-shape by the first one-side-edge 4 and the second one-side-edge 5 of a pair of the forming-rollers 1, 2.

A phenomenon of spring-back is caused in the one-side-cut-louver 7 formed in this way when the one-side-cut-louver 7 is separated from the pair of forming-rollers 1, 2. As two inclined faces 70 of the one-side-cut-louver 7 are formed with the both-side-edge 3 for forming the both-side-cut louver 8 at this time, a blade contact length of the inclined face 70 of the one-side-cut-louver 7 and a blade contact length of the both-side-cut-louver 8 become equal to each other. Therefore, an amount of spring-back of the one-side-cut-louver 7 and an amount of spring-back of the both-side-cut-louver 8 can be made to be the same. At this time, in order to form the one-side-cut-louver 7 of the central turning portion, it is possible to use the both-side-edge 3. Therefore, it is unnecessary to use an edge, the shape of which is special. Accordingly, with a simple structure, an inclination angle of the one-side-cut-louver 7 can be made to be the same as an inclination angle of the both-side-cut-louver 8, which is adjacent to the one-side-cut-louver 7.

Next, an air current in the corrugated fin of the present embodiment will be explained below.

Figure 3:
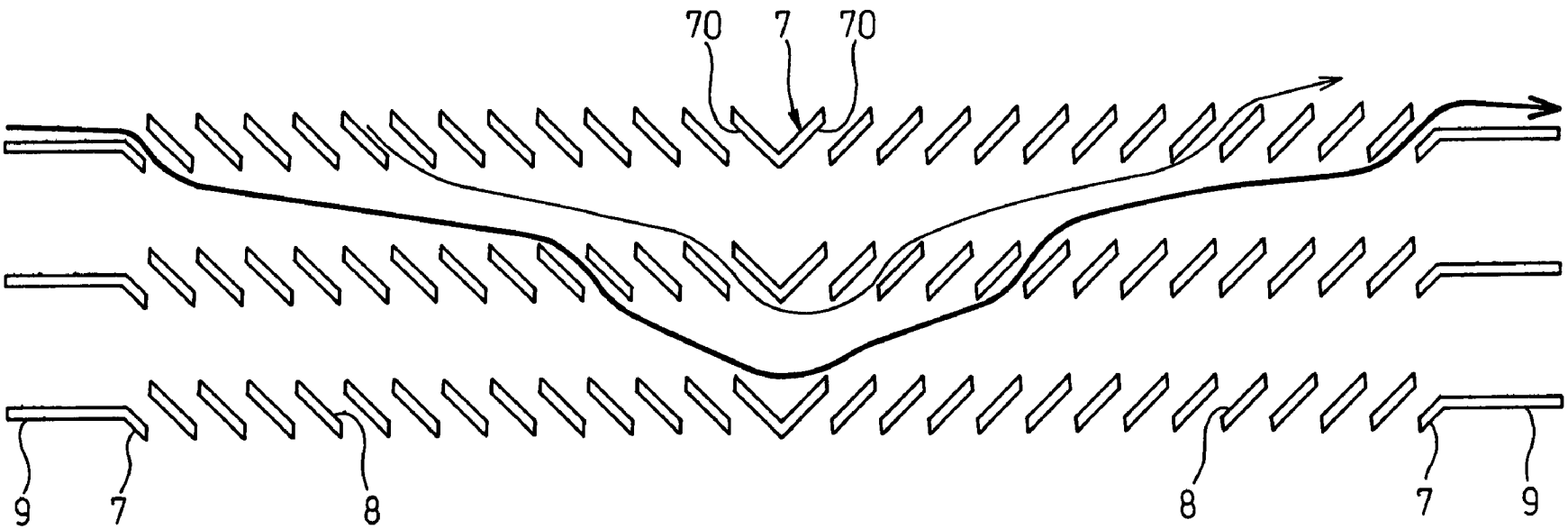
FIG. 3 is a schematic illustration for explaining a result of a visualization experiment of visualizing an air current in the corrugated fin of the first embodiment.

FIG. 3 is a schematic illustration for explaining a result of a visualization experiment of visualizing an air current in the corrugated fin of the first embodiment.

As shown in FIG. 3, in the central turning portion, an inclination angle of the one-side-cut-louver 7 is the same as an inclination angle of the both-side-cut-louver 8. Therefore, an air current of each portion of the louver (sloping slat) can be made the same and the heat exchanging performance can be enhanced. In the central turning portion, a length of the inclined face 70 of the one-side-cut-louver 7 is the same as that of the both-side-cut-louver 8. Therefore, an air current can be easily turned. Due to the foregoing, while a direction of the air current is being maintained in an ideal direction (V-shaped current), the heat exchange can be facilitated.

Figure 4:
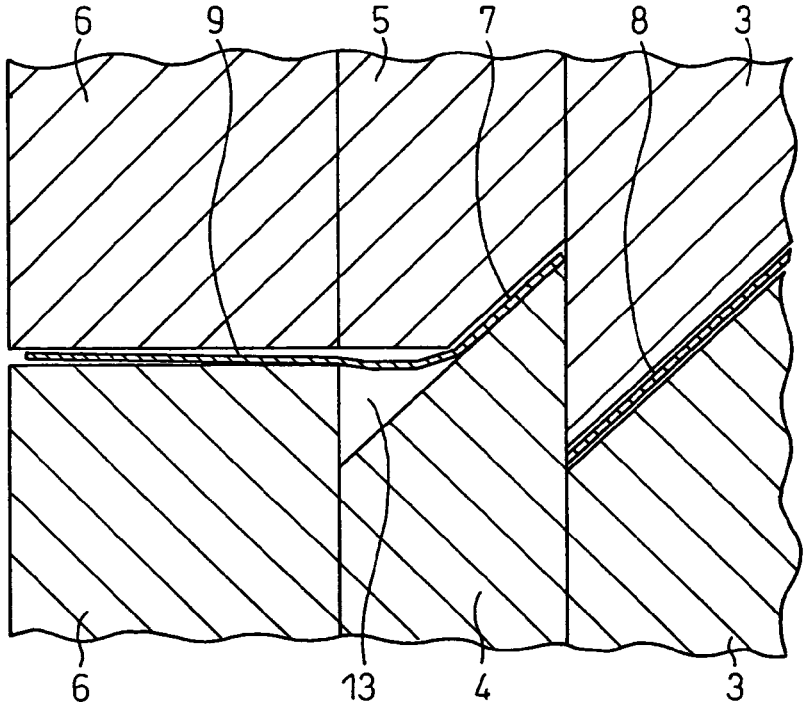
Fig. 4 PRIOR ART
FIG. 4 is a sectional view for explaining a. conventional corrugated-fin-forming-roller at the time of forming.

In this connection, in some cases, in order to enhance the heat exchange performance, louvers are made to be fine in a corrugated fin, that is, a length of each louver is shortened. In this case, as shown in FIG. 4, when the louver is formed, the one-side-cut-louver 7 does not come into contact with the first one-side-cut-edge 4. That is, a gap 13 is formed between the one-side-cut-louver 7 and the first one-side-cut-edge 4. Therefore, it is difficult for the one-side-cut-louver 7 to be formed bent.

Figure 5:
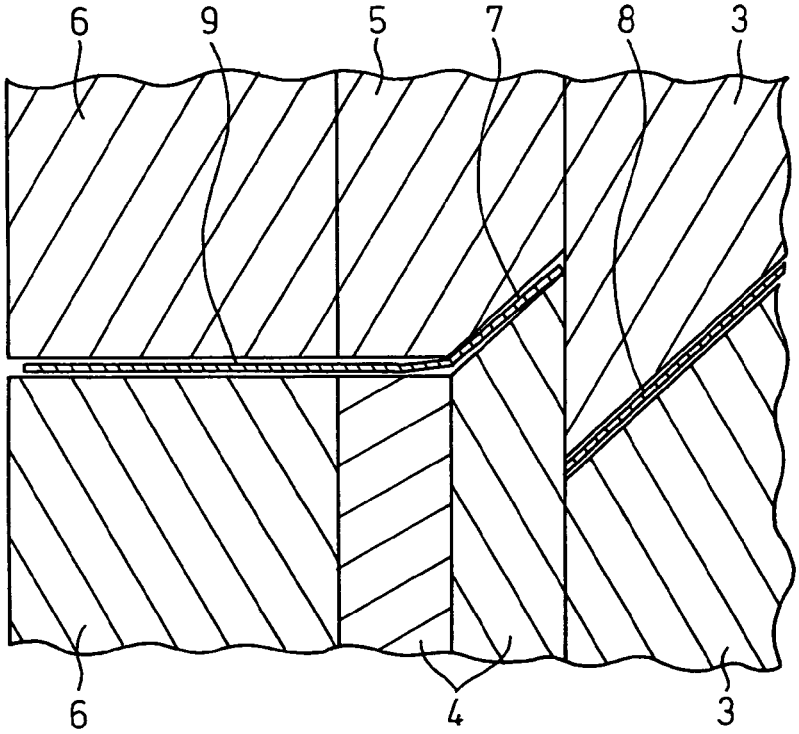
FIG. 5 is a sectional view for explaining a variation in which the corrugated-fin-forming-roller shown in FIG. 4 is varied.

On the other hand, when the first one-side-edge 4 is divided as shown in FIG. 5, the one-side-cut-louver 7 and the first one-side-edge 4 are contacted with each other. Therefore, the one-side-cut-louver 7 can be easily bent and formed. However, when the blade is machined by means of grinding so as to reduce the wall thickness, the wall thickness capable of being machined is limited. Therefore, it is difficult to manufacture the thus divided blade. Accordingly, when the thus divided blade is manufactured, the manufacturing cost is raised.

Therefore, as shown in the present embodiment, when the one-side-cut-louver 7 is formed into a substantial V-shape, at the time of forming the louver, it is possible to make the one-side-cut-louver 7 come into contact with the first one-side-edge 4. Accordingly, even when a length of the louver is shortened, the one-side-cut-louver 7 can be formed bent with a simple structure.

In order to enhance the heat exchange performance, in a corrugated fin, the louvers are made to be fine and the wall thickness of the material of the louvers is reduced in some cases. However, in this case, a problem is caused in which the buckling strength of the corrugated fin is deteriorated.

On the other hand, when the one-side-cut-louver 7 is formed into a V-shape like the present embodiment, the buckling strength of the corrugated fin can be greatly increased, which is effective for making the louvers fine and reducing the wall thickness.

Second Embodiment

Figure 6:
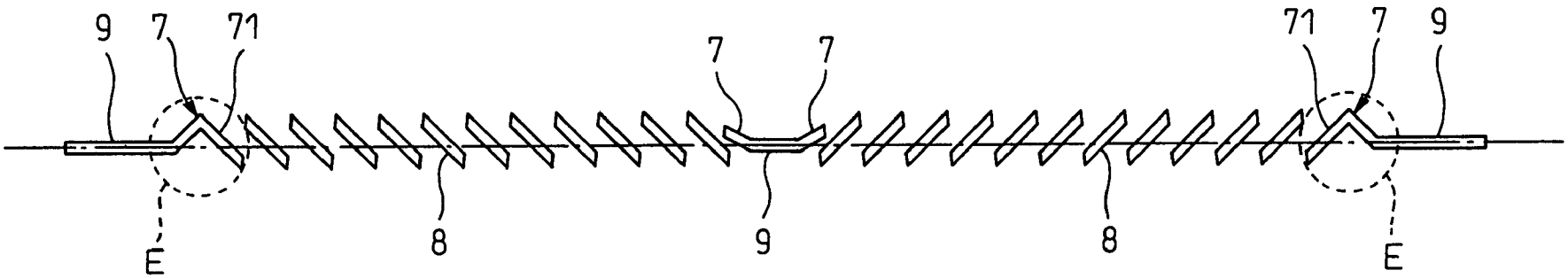
FIG. 6 is a sectional view for explaining louvers of a corrugated fin of a second embodiment of the present invention.
Figure 7:
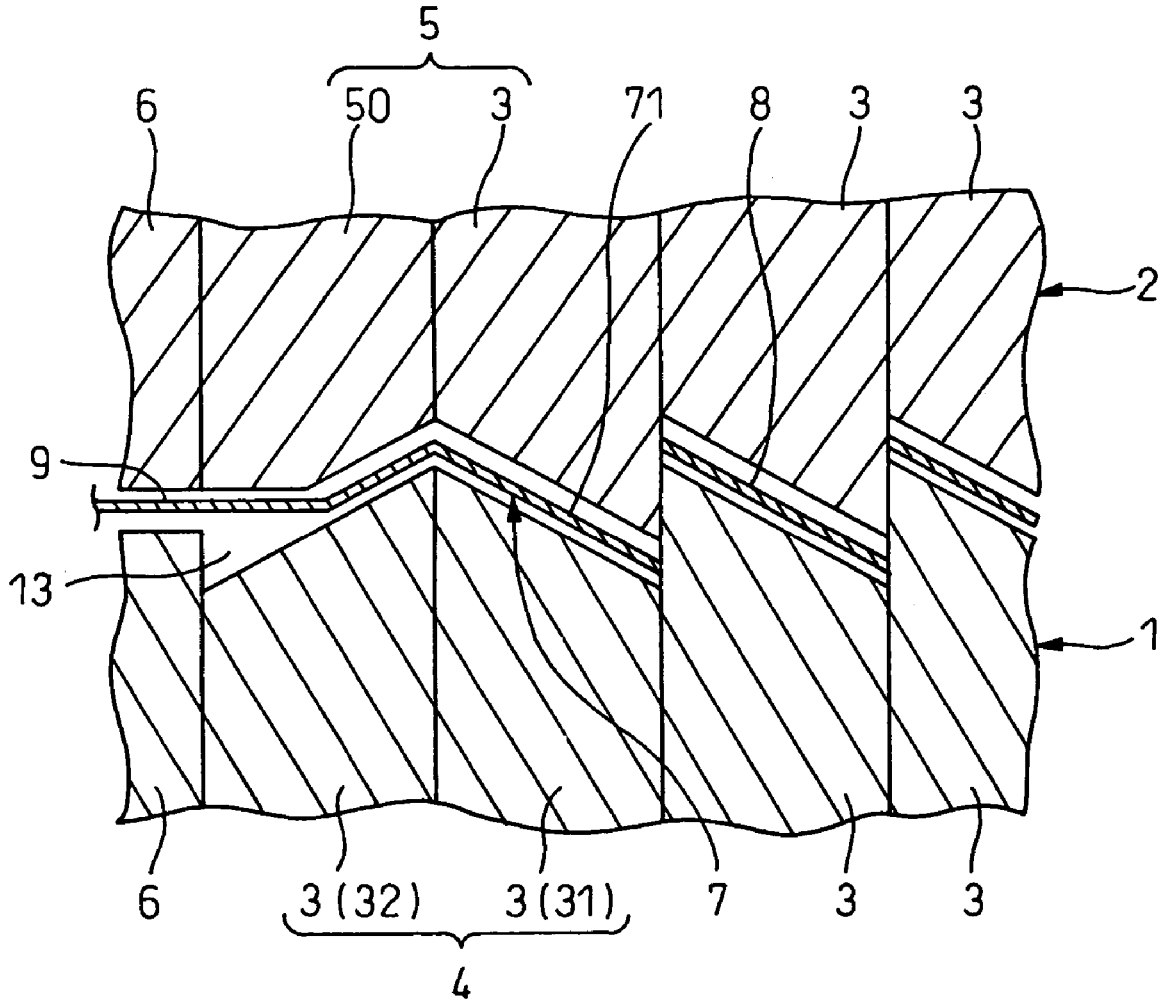
FIG. 7 is a sectional view for explaining a corrugated fin-forming-roller at the time of forming the corrugated fin in the second embodiment.
Figure 8:
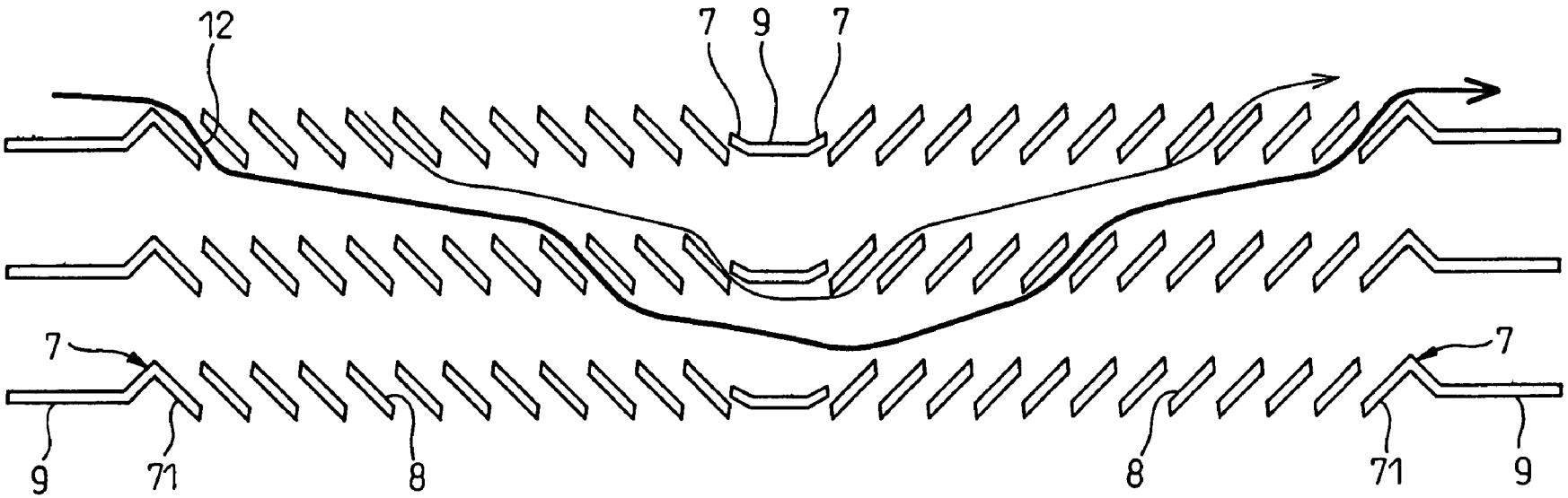
FIG. 8 is a schematic illustration for explaining a result of a visualization experiment of visualizing an air current in the corrugated fin of the second embodiment.

Referring to FIGS. 6 to 8, the second embodiment of the present invention will be explained below. Like reference characters are used to indicate like parts in the first and the second embodiment.

FIG. 6 is a sectional view for explaining louvers of the corrugated fin of the second embodiment of the present invention. In FIG. 6, the one-dotted chain line shows a centerline in the wall thickness direction of the corrugated fin.

As shown by portion E in FIG. 6, one-side-cut-louvers 7, which are arranged at both end portions of a group of louvers, are respectively formed in such a manner that an inclined face (referred to as an inside-inclined-face 71) of the one-side-cut-louver 7, the shape of which is a substantial V-shape, on the side of the adjoining both-side-cut-louver 8 (inside in the louver laminating direction) crosses the centerline of the fin wall thickness direction. A length of the inside-inclined-face 71 is the same as that of the adjoining both-side-cut-louver 8, and a direction of the inside-inclined-face 71 is the same as that of the adjoining both-side-cut-louver 8.

Next, a method of forming the corrugated fin of the present embodiment will be explained below.

FIG. 7 is a sectional view for explaining a corrugated fin-forming-roller at the time of forming a corrugated fin in the second embodiment. In this connection, FIG. 7 shows a state in which a metallic strip is supplied to a pair of the first forming-roller 1 and the second forming-roller 2 and the forming-rollers are a little away from the roller engaging state.

As shown in FIG. 7, in the corrugated fin-forming-roller, the first one-side-edge 4 for forming the one-side-cut-louvers 7 at both end portions of the group of louvers includes two both-side-edges 3. More specifically, the both-side-edge (referred to as an inside-both-side-edge 31 hereinafter) arranged inside in the louver laminating direction in the two both-side-edges 3 composing the first one-side-edge 4 is arranged in the same direction as that of the adjoining both-side-edge 3. That is, the both-side-edge 3 (referred to as an outside-both-side-blade 32 hereinafter) arranged outside in the louver laminating direction is arranged in the opposite direction to the inside-both-side-blade 31.

The second one-side-edge 5 includes the both-side-edge 3 and the divided one-side-edge 50. More particularly, the both-side-edge 3 in the two blades composing the second one-side-edge 5 is arranged inside in the louver laminating direction in the same direction as that of the adjoining both-side-edge 3. The divided one-side-edge 50 is arranged outside in the louver laminating direction. The divided one-side-edge 50 includes: an inclined face, the top of which is a contact point with the both-side-edge 3, which is inclined being symmetrical with the adjoining both-side-edge 3; and a flat face of the edge continuing to the adjoining forming blade 6.

Therefore, when a metallic strip is supplied, the metallic strip is bent into a substantial V-shape by the first one-side-edge 4 and the second one-side-edge 5 of a pair of the forming-rollers 1, 2. At this time, an inclination angle of the inside inclined face 71 of the one-side-cut-louver 7 is the same as that of the both-side-cut-louver 8.

A phenomenon of spring-back is caused in the one-side-cut-louver 7 formed in this way when the one-side-cut-louver 7 is separated from the pair of forming-rollers 1, 2. At this time, an edge contact length of the one-side-cut-louver 7 is longer than that of the both-side cut-louver 8. Therefore, an amount of spring-back of the one-side-cut-louver 7 is smaller than an amount of spring-back of the both-side-cut-louver 8. Further, as the inside inclined face of the one-side-cut-louver 7 crosses the centerline in the wall thickness direction of the fin, the phenomenon of spring-back is seldom caused by the rib effect. At this time, in order to form the one-side-cut-louver 7 at the end portion of the group of louvers, it is possible to partially use the both-side-edge 3. Therefore, it is unnecessary to form the overall one-side-edge 4, 5 into a special shape. Accordingly, it is possible to reduce a difference of the inclination angle between the one-side-cut-louver 7 and the both-side-cut-louver 8 with a simple structure.

Next, an air current in the corrugated fin of the present embodiment will be explained below.

FIG. 8 is a schematic illustration for explaining a result of a visualization experiment of visualizing an air current in the corrugated fin of the second embodiment.

As shown in FIG. 8, an inclination angle of the inside-inclined faces 71 of the one-side-cut-louvers at both end portions of the group of the louvers is substantially the same as that of the both-side-cut-louver 8. Therefore, an air current at each portion of the louver is substantially the same and the heat exchange performance can be enhanced. Further, it is possible to positively introduce an air current from the opening portion 12 formed between the one-side-cut-louver 7 and the both-side-cut-louver 8. Accordingly, the heat exchange performance can be more highly enhanced.

When-the one-side-cut-louver 7 is formed into a substantially V-shape like the present embodiment, it is possible to make the gap 13, which is formed between the one-side-cut-louver 7 and the first one-side-blade 4, exist except at the portion in which an air current in the louver is controlled. Therefore, even in the case where a length of the louver is reduced, the one-side-cut-louver 7 can be formed being bent with a simple structure.

When the one-side-cut-louver 7 is formed into a substantial V-shape like the present embodiment, the buckling strength of the corrugated fin can be greatly enhanced, which is effective for making the louvers fine and reducing the wall thickness.

Third Embodiment

Next, referring to FIGS. 9 to 11, the third embodiment of the present invention will be explained below. The corrugated fin of this embodiment is different from that of the second embodiment described above in the structure of the central turning portion. Like reference characters are used to indicate like parts in the second and the third embodiment and explanations are omitted here.

Figure 9:
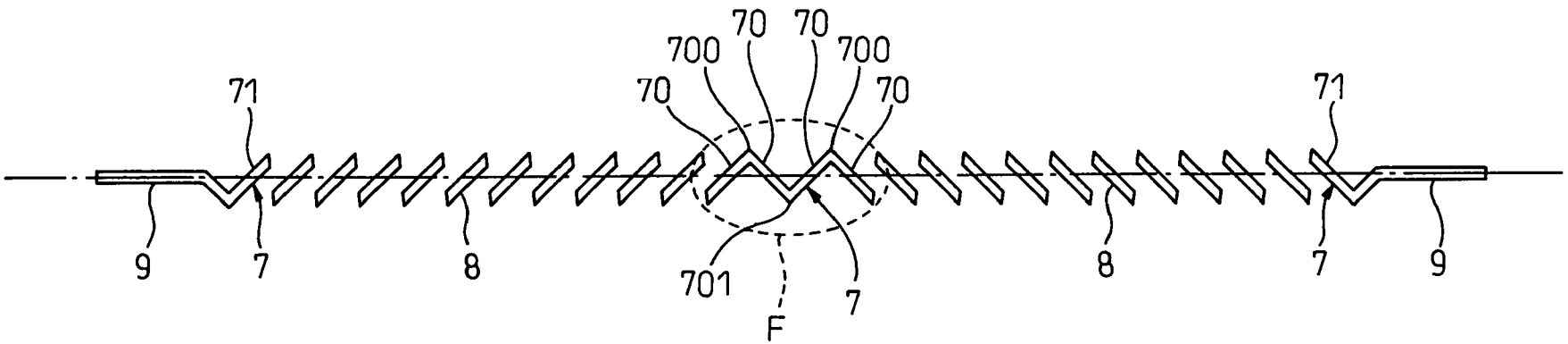
FIG. 9 is a sectional view for explaining louvers of a corrugated fin of a third embodiment of the present invention.

FIG. 9 is a sectional view for explaining louvers of the corrugated fin of the third embodiment of the present invention. In FIG. 9, the one-dotted chain line shows a centerline in the wall thickness direction of the corrugated fin.

As shown by portion F in FIG. 9, the one-side-cut-louver 7 of the central turning portion-is formed in such a manner that a cross-section in the louver laminating direction is formed into a substantial W-shape. In this case, in the one-side-cut-louver 7, two protruding portions (referred to as outside-protruding-portions 700 hereinafter) on the outside in the louver laminating direction in the substantially W-shape are protruded from a centerline of the fin in the wall thickness direction onto an opposite side to the side on which the end portions of the both-side-cut-louvers 8 are arranged. A protruding portion (referred to as an inside-protruding-portion 701 hereinafter) on the inside in the louver laminating direction of the substantial W-shape is protruded from the centerline of the fin in the wall thickness direction onto an opposite side to the side on which the outside-protruding-portions 700 are arranged.

In other words, all the four inclined faces 70 composing the substantial W-shape cross the centerline in the fin wall thickness direction.

Next, a method of forming the corrugated fin of the present embodiment will be explained below.

Figure 10:
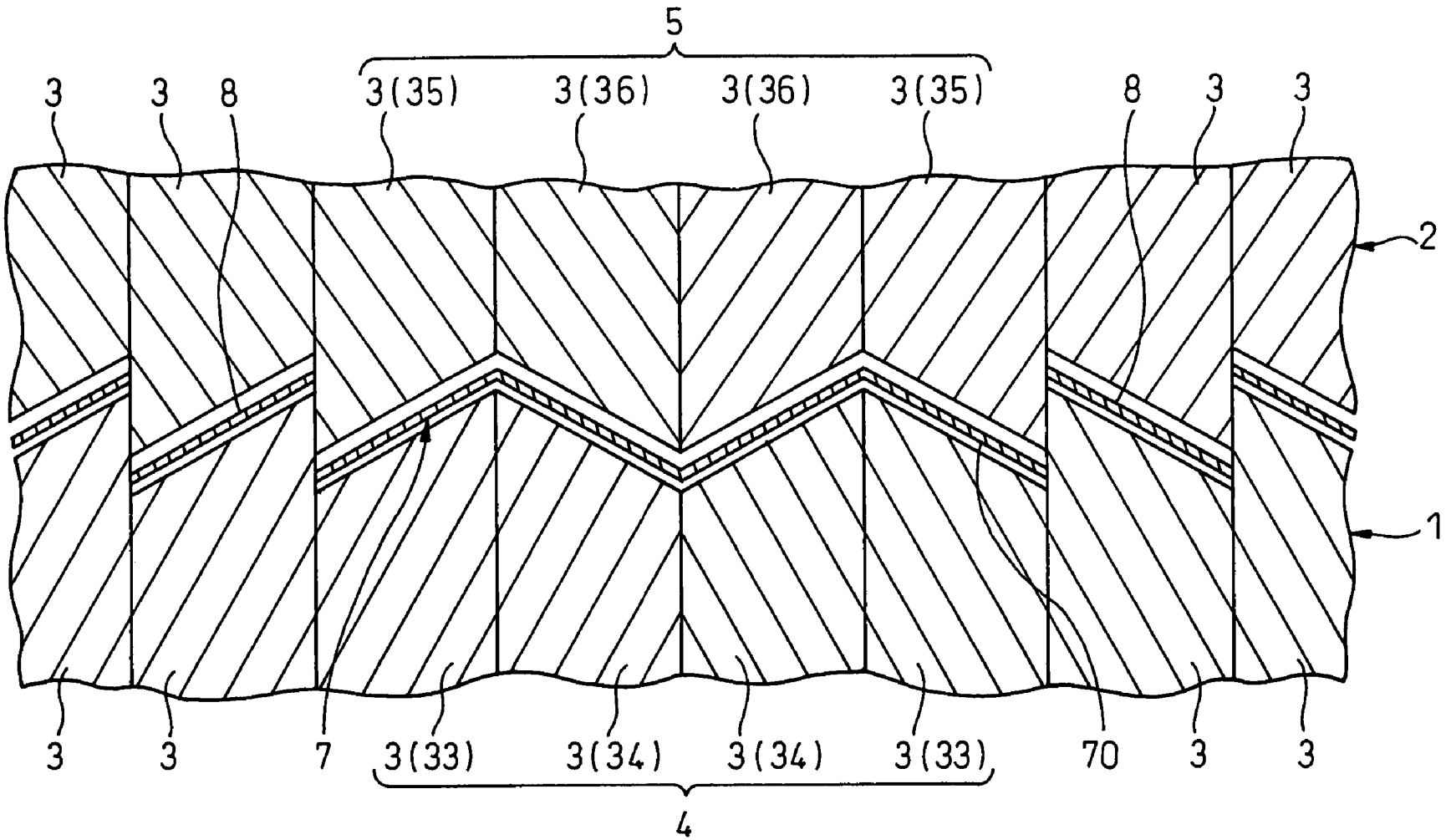
FIG. 10 is a sectional view for explaining a corrugated-fin-forming-roller at the time of forming the corrugated fin in the third embodiment.

FIG. 10 is a sectional view for explaining a corrugated-fin-forming-roller at the time of forming in the third embodiment. In this connection, FIG. 10 shows a state in which a metallic strip is supplied to a pair of the first forming-roller 1 and the second forming-roller 2 and the forming-rollers are a little away from the roller engaging state.

As shown in FIG. 10, the first one-side-blade 4 of the corrugated fin-forming-roller of the present embodiment includes four both-side-edges 3, which are alternatively arranged in a different direction. More specifically, two both-side-edges 3 (referred to as the first outside both-side-edges 33 hereinafter), which are arranged on the outside in the louver laminating direction, in the four both-side-edges 3 composing the first one-side-edge 4, are arranged in the same direction as that of the group of the adjoining both-side-edges 3. Two both-side-edges 3 (referred to as the first inside-both-side-edges 34 hereinafter) arranged on the inside in the louver laminating direction are arranged in an opposite direction to that of the adjoining first outside both-side-edges 33.

In the same manner, the second one-side-edge 5 of the corrugated fin-forming-roller of the present embodiment includes four both-side-edges 3, which are alternatively arranged in a different direction. More specifically, two both-side-edges 3 (referred to as the second outside both-side-edges 35 hereinafter), which are arranged on the outside in the louver laminating direction, in the four both-side-edges 3 composing the second one-side-blade 5, are arranged in the same direction as that of the group of the adjoining both-side-blades 3. Two both-side-edges 3 (referred to as the second inside both-side-edges 36 hereinafter) arranged on the inside in the louver laminating direction are arranged in an opposite direction to that of the adjoining second outside both-side-edges 35.

Therefore, when a metallic strip is supplied, the metallic strip is bent into a substantial W-shape by the first one-side-edge 4 and the second one-side-edge 5 of a pair of forming-rollers 1, 2. At this time, an inclination angle of the inclined face 70 of the both-side-cut-louver 8 group of the one-side-cut-louver 7 is the same as that of the adjoining both-side-cut-louver 8.

A phenomenon of spring-back is caused in the one-side-cut-louver 7 formed in this way when the one-side-cut-louver 7 is separated from the pair of forming-rollers 1, 2. At this time, a blade contact length of the one-side-cut-louver 7 is longer than that of the both-side-cut-louver 8. Therefore, an amount of spring-back of the one-side-cut-louver 7 is smaller than an amount of spring-back of the both-side-cut-louver 8. Further, as the one-side-cut-louver 7 is formed into a substantial W-shape and all the four inclined faces 70 composing the substantial W-shape cross the centerline in the fin wall thickness direction, the phenomenon of spring-back is seldom caused due to the rib effect. At this time, in order to form the one-side-cut-louver 7 at the central turning portion, it is possible to partially use the both-side-edge 3. Therefore, it is unnecessary to use a blade of a special shape. Accordingly, it is possible to reduce a difference of the inclination angle between the one-side-cut-louver 7 and the both-side-cut-louver 8 with a simple structure.

Next, an air current in the corrugated fin of the present embodiment will be explained below.

Figure 11:
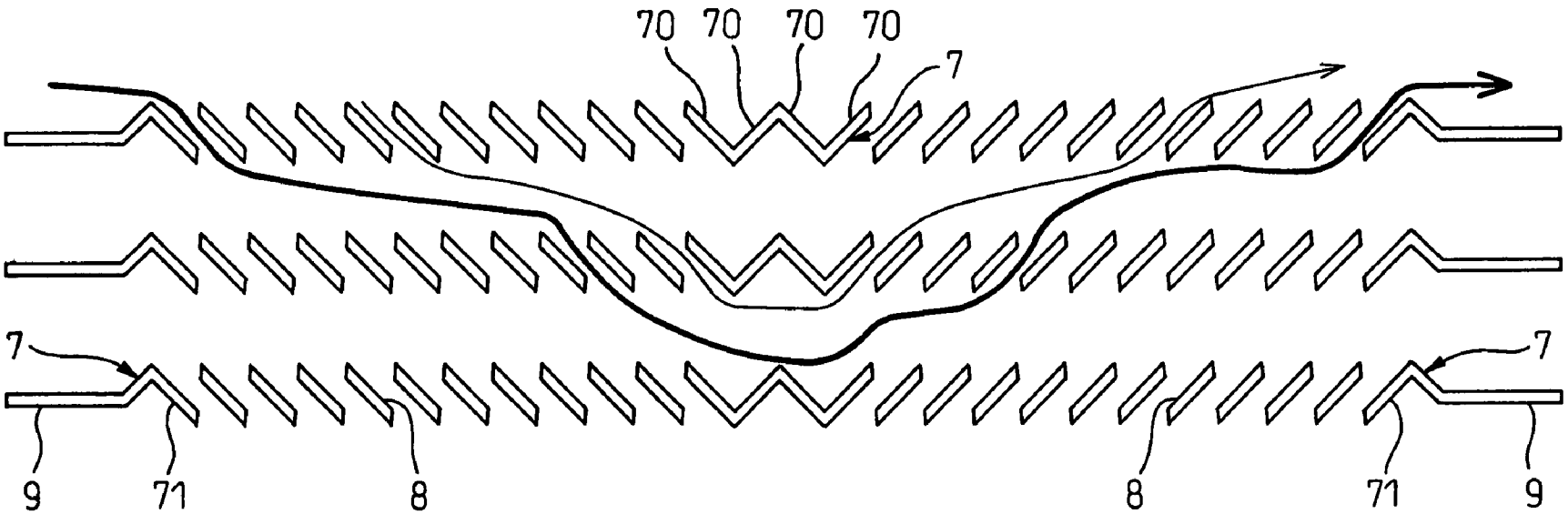
FIG. 11 is a schematic illustration for explaining a result of a visualization experiment of visualizing an air current in the corrugated fin of the third embodiment.

FIG. 11 is a schematic illustration for explaining a result of a visualization experiment of visualizing an air current in the corrugated fin of the third embodiment.

As shown in FIG. 11, a difference between the inclination angle of the inclined face 70 of the one-side-cut-louver 7 of the central turning portion adjoining the both-side-cut-louver 8 and the inclination angle of the both-side-cut-louver 8 is reduced, an air current in each portion of the louvers can be made to be substantially the same. Therefore, the heat exchange performance can be enhanced.

Further, even in the central turning portion, it is possible to provide a forward-end effect by the inside-protruding-portion 701 of the one-side-cut-louver 7. Therefore, the heat transfer coefficient can be enhanced.

When the one-side-cut-louver 7 of the central turning portion is formed into a substantial W-shape, the length of the central turning portion in the louver laminating direction can be increased. Therefore, it is possible to ensure a sufficiently long section necessary for turning a direction of the air current. Due to the foregoing, the air current can be maintained in an ideal direction (a V-shaped current). Therefore, the heat exchange can be facilitated.

When the one-side-cut-louver 7 is formed into a substantial W-shape as in the present embodiment, the one-side-cut-louver 7 can be contacted with the one-side-blade 4 at the time of forming the louver. Therefore, even in the case where a length of the louver is reduced, the one-side-cut-louver 7 can be formed bent with a simple structure.

When the one-side-cut-louver 7 is formed into a substantial W-shape as in the present embodiment, it is possible to greatly enhance the buckling strength of the corrugated fin, which is effective for making the louver fine and reducing the wall thickness.

Another Embodiment

Figure 12:
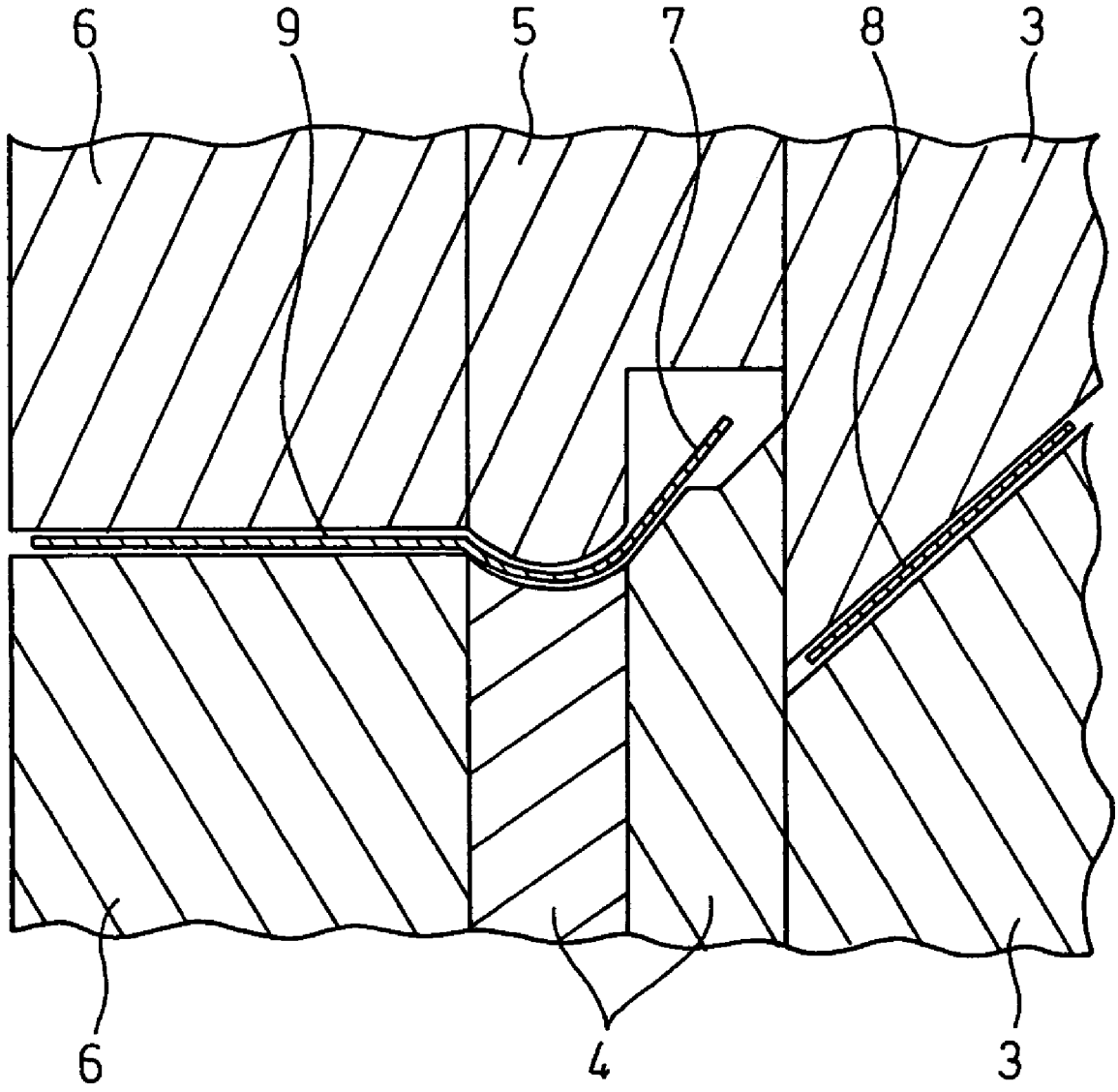
FIG. 12 is a sectional view for explaining a variation of the substantially V-shape of the one-side-cut-louver 7 which is another embodiment of the present invention.
Figure 13:
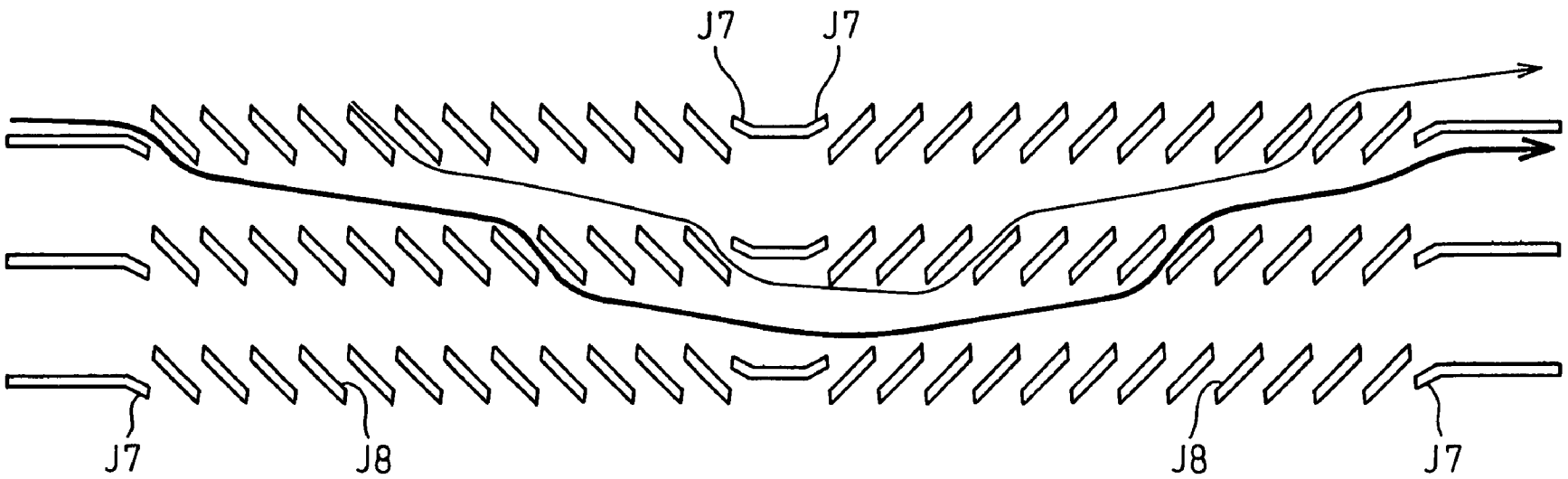
Fig.13 PRIOR ART
FIG. 13 is a schematic illustration for explaining a result of a visualization experiment of visualizing an air current in a conventional corrugated fin.

In this connection, in the above first and the second embodiment, the substantial V-shape of the one-side-cut-louver 7 is linearly formed. However, it should be noted that the present invention is not limited to the above specific embodiment. For example, as shown in FIG. 12, the one-side-cut-louver 7 may be formed into a dimple-shape (a dome-shape).

In the third embodiment described before, all the inclined faces 70 of the one-side-cut-louver 7 forming the substantial W-shape cross the centerline in the fin wall thickness direction. However, it is sufficient that at least one inclined face 70 crosses the centerline in the fin wall thickness direction. For example, only two outside-inclined-faces in the four inclined faces 70 may cross the centerline in the fin wall thickness direction.

In the third embodiment described before, the one-side-cut-louver 7, the shape of which is formed into a substantial W-shape, is arranged in the central turning portion. However, it should be noted that the present invention is not limited to the above specific embodiment. The one-side-cut-louvers 7, the shape of which is formed into a substantial W-shape, may be arranged at both end portions of the group of louvers.

In a heat exchanger including a plurality of tubes in which a heat transfer medium flows and also including a fin joined onto an external surface of each tube, the corrugated fin in each embodiment described above may be used for the fin. Due to the foregoing, the heat exchange capacity of the heat exchanger can be enhanced.

It is possible to combine the above embodiments with each other.

While the invention has been described by reference to specific embodiments chosen for purposes of illustration, it should be apparent that numerous modifications could be made thereto, by those skilled in the art, without departing from the basic concept and scope of the invention.

The invention claimed is:

1. A corrugated fin bent and formed into a wave-shape, comprising a plurality of both-side-cut-louvers, which are laminated on each other and formed into a group, and one-side-cut-louvers, which are arranged at end portions of the group of both-side-cut-louvers, being raised from the corrugated fin; wherein a cross section in the louver laminating direction of at least one of the one-side-cut-louvers is formed into a substantial V-shape, an inclined face of the one-side-cut-louver adjacent to the both-side-cut-louver crosses a centerline of the fin in the wall thickness direction and a length of the adjoining inclined face of the one-side-cut-louver is the same as that of the inclined face of the both-side-cut-louver;

the plurality of both-side-cut-louvers includes two groups of both-side-cut louvers, the inclination directions of which are opposite to each other, and a respective one-side-cut-louver, the shape of which is formed into a V-shape, is arranged at both end portions of the two groups of both-side-cut-louvers.

2. A corrugated fin according to claim 1, wherein a one-side-cut-louver is arranged between the groups of both-side-cut-louvers.

3. A corrugated fin according to claim 1, wherein the inclination angle of the both-side-cut-louver and that of the one-side-cut-louver are inclined at substantially the same angle.

4. A corrugated fin according to claim 1, wherein a one-side-cut-louver, the shape of which is formed into a substantial W-shape, is arranged between the groups of the both-side-cut-louvers.

5. A heat exchanger comprising: a plurality of tubes in which a heating medium flows; and fins joined onto external faces of the tubes, for facilitating heat exchange with the heating medium, wherein the fins are the corrugated fins according to claim 1.

6. A corrugated fin formed into wave-shape, comprising a substantially plate-shaped plane portion, a plurality of first louvers, which are formed by cutting both sides of each louver and displacing each cut edge in opposite directions, each of the plurality of first louvers having a first inclined plane that is inclined with respect to the plate-shaped plane portion, and a plurality of second louvers, which are formed by cutting a side of each louver and displacing a cut edge disposed adjacent the plurality of first louvers to form a second inclined plane that is inclined with respect to the plate-shaped plane portion, wherein one of the plurality of second louvers forming the second inclined plane crosses a centerline of the plate-shaped plane portion, the second inclined plane having a same width as the first inclined planes;

the plurality of first louvers includes two groups of first louvers, the inclination directions of which are opposite to each other; and a respective second louver, the shape of which is formed into a V-shape, is arranged at both end portions of the two groups of first louvers.

7. A corrugated fin formed into a wave-shape, the corrugated fin comprising:

a substantially plate-shaped plane portion;

a plurality of first louvers, each louver of the plurality of first louvers having two cut sides, one cut side being disposed above the plane portion, one cut side being disposed below the plane portion, each louver of the plurality of first louvers defining a first inclined plane disposed at an angle with respect to the plane portion;

a plurality of second louvers, each louver of the plurality of second louvers having a single cut side, the single cut side being disposed adjacent one of the plurality of first louvers, each louver of the plurality of second louvers defining a second inclined plane disposed at an angle with respect to the plane portion, wherein:

the second inclined plane of one of the plurality of second louvers crosses a centerline of the plate portion and has a width equal to a width of the first inclined planes;

the plurality of first louvers includes two groups of first louvers, the inclination directions of which are opposite to each other; and a respective second louver, the shape of which is formed into a V-shape, is arranged at both end portions of the two groups of first louvers.

* * * * *